United States Patent [19]

Haffely et al.

[11] Patent Number: 5,016,693

[45] Date of Patent: May 21, 1991

[54] GUIDE FENCE FOR POWER TOOLS

[75] Inventors: Jeff L. Haffely, Gibsonia; Mark G. Stahler, Oakmont; Barry D. Wixey, Pittsburgh, all of Pa.

[73] Assignee: Delta International Machinery Corporation, Pittsburgh, Pa.

[21] Appl. No.: 525,266

[22] Filed: May 22, 1990

[51] Int. Cl.[5] ..... B27B 31/00

[52] U.S. Cl. ..... 144/253 J; 144/134 A; 144/253 R

[58] Field of Search ..... 144/134 R, 134 A, 253 R, 144/253 J, 286 R, 286 A; 83/859

[56] References Cited

U.S. PATENT DOCUMENTS

| | | | |
|---|---|---|---|
| 727,337 | 5/1903 | Forster | 144/253 J |
| 2,104,158 | 1/1938 | Hedgpeth | 144/253 J |
| 4,798,113 | 1/1989 | Viazanko | 144/286 R |

*Primary Examiner*—W. Donald Bray

*Attorney, Agent, or Firm*—Merchant, Gould, Smith, Edell, Welter & Schmidt

[57] ABSTRACT

A guide fence providing an adjustable gap for accommodating variously configured cutting mechanisms which includes (i) a plurality of longitudinally elongated members having a generally V-shaped cross-section, and (ii) a means for releasable coupling a plurality of nested elongated members so as to create a planar guiding surface from a first lateral side of the nested members.

14 Claims, 4 Drawing Sheets

GUIDE FENCE FOR POWER TOOLS

FIELD OF THE INVENTION

Broadly, the invention relates to guide fences for power tools. Specifically, the invention relates to guide fences which provide a central gap for accommodating a rotating cutting mechanism.

BACKGROUND OF THE INVENTION

Guide fences are employed with a wide variety of power tools where a workpiece is moved relative to a stationary cutting mechanism. The guide fence provides a straight surface against which the workpiece may be guided in order to ensure a uniform cut.

A first type of guide fence provides a continuous guiding surface which clamps to the table of the power tool by releasable clamping mechanisms located at the longitudinal ends of the guiding surface. Such guide fences are well suited for use in connection with power tools which require a guiding surface remotely positioned from the cutting mechanism, such as a bench saw. However, such guide fences are not suited for use in connection with power tools which require a guiding surface aligned with the cutting mechanism.

A second type of fence guide suited for use in connection with power tools which require a guiding surface aligned with the cutting mechanism employs a guiding surface with a centrally located gap for accommodating the cutting mechanism. The central gap is generally provided by either removing a section from a single continuous guiding surface or employing two separate guiding surfaces. The central gap is generally sized as small as possible to reduce the risk of misalignment as the workpiece passes over the gap while accommodating the largest cutting mechanism capable of being used in the tool. However, because of the substantial differences in the sizes of cutting mechanisms typically employable in power tools, the gap is often considerably larger than that necessary to accommodate the particular cutting mechanism being employed.

Accordingly, a substantial need exists for a guide fence capable of providing a central gap which can be readily adjusted to customize the size and shape of the gap to a particular cutting mechanism.

SUMMARY OF THE INVENTION

We have developed a guide fence for power tools which provides a guiding surface with a gap which can be readily adjusted to customize the size and/or shape of the gap to a particular cutting mechanism.

A particular guide fence capable of providing the desired adjustability includes (i) a plurality of longitudinally elongated members having a first transverse surface which is laterally convex and a second transverse surface diametrically opposed to the first transverse surface which is laterally concave, and (ii) a means for releasably coupling at least two members which are nested with the convex surface of one member nested within the concave surface of a second member such that a flat guiding surface is formed from the first lateral sides of the nested members.

DETAILED DESCRIPTION OF THE INVENTION INCLUDING A BEST MOLD

Figure 1:
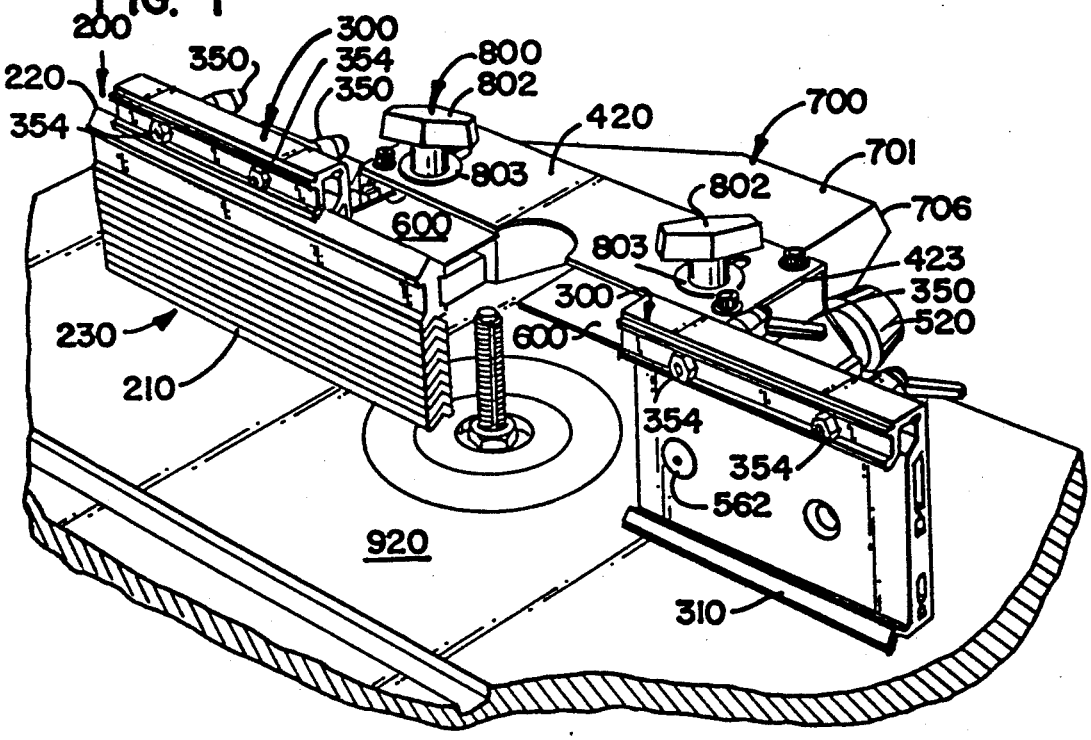
FIG. 1 is a perspective view of one embodiment of the invention.

The guide fence produces a flat guiding surface with an adjustable central gap from a pair of identical fence assemblies. The fence assemblies are readily adjustable to customize the size and shape of the gap to a particular cutting mechanism.

The guide fence is particularly well suited for utilization in conjunction with a wood shaper. Accordingly, without intending to be limited thereby, the guide fence will hereinafter be referenced with respect to utilization in conjunction with a wood shaper.

NOMENCLATURE

100: guide fence
101: longitudinal direction
102: lateral direction
103: transverse direction
200: fence assembly
210: small fence segments
**210*m***: length of small fence segments
**210*w***: width of small fence segments
**210*t***: thickness of small fence segments
211: top of small fence segments
**211*a***: apex at top of small fence segments
212: bottom of small fence segments
**212*a***: nadir at bottom of small fence segments
213: inner end of small fence segments
214: outer end of small fence segments
215: front of small fence segments
**215*a***: a front leg of small fence segments
216: rear of small fence segments
**216*a***: rear leg of small fence segments
220: large fence segments
**220*m***: length of large fence segments
**220*w***: width of large fence segments
**220*t***: thickness of large fence segments
221: top of large fence segments
**221*a***: apex at top of large
221i b: front top portion of large fence segments
222: bottom of large fence segments
**222*a***: nadir at bottom of large fence segments
223: inner end of large fence segments
224: outer end of large fence segments
225: front of large fence segments
**225*a***: front leg of large fence segments
226: rear of large fence segments
**226*a***: rear leg of large fence segments
227: front channel on large fence segments
228: rear channel on large fence segments
230: guiding surface
250: central gap between fence assemblies
300: segment clamp 303: inner end of segment clamp
304: outer end of segment clamp
310: base of segment clamp
311: top of segment clamp base
311*a*: apex at top of segment clamp base
320: sidewall of segment clamp
321: front surface of segment clamp sidewall
322: orifice through segment clamp sidewall
323: threaded holes in inner end of segment clamp
330: top of segment clamp
330*a*: top front portion of segment clamp
330*b*: top rear portion of segment clamp
331: flex line
332: pivotable contacting surface of segment clamp
341: diagonal channel
342: orifice through top of segment clamp
343: channel across top front portion of segment clamp
350: clamping knob
351: shaft of clamping knob
352: handle of clamping knob
353: flat washers
354: nuts
360: direction of clamping force
400: support half
401: top of support half
402: bottom of support half
403: inner surface of support half
404: outer surface of support half
405: front of support half
406: rear of support half
410: passageway through support half
411: slit through outer surface of support half
412: T-shaped channel along top of support half
420: cover plate
421: slits through cover plate
422: orifices through cover plate
423: right side of cover plate
424: left side of cover plate
500: tube
501: central bore through tube
502: orifice through side of tube
505: front end of tube
506: rear end of tube
520: fine tuning knob
521: central bore through fine tuning knob
540: tube locking knob
541: shaft of tube locking knob
542: handle of tube locking knob
545: washers
561: first pair of bolts
562: second pair of bolts
600: dust deflector plates
602: top of dust deflector plates
602: side of dust deflector plates
603: orifices through side of dust deflector plates
700: dust chute
701: top of dust chute
703: right side of dust chute
704: left side of dust chute
705: front of dust chute
706: back of dust chute
711: top front flange on dust chute
713: right front flange on dust chute
714: left front flange on dust chute
715: orifices through right and left front flanges
716: indent in right and left front flanges
751: first set of machine screws
752: flat washers
753: nuts
755: second set of machine screws
757: third set of machine screws
800: support half locking knob
801: shaft of fence locking knob
802: handle of fence locking knob
803: flat washers
910: cutting tool
920: working surface
921: threaded holes in table

CONSTRUCTION

Figure 2:
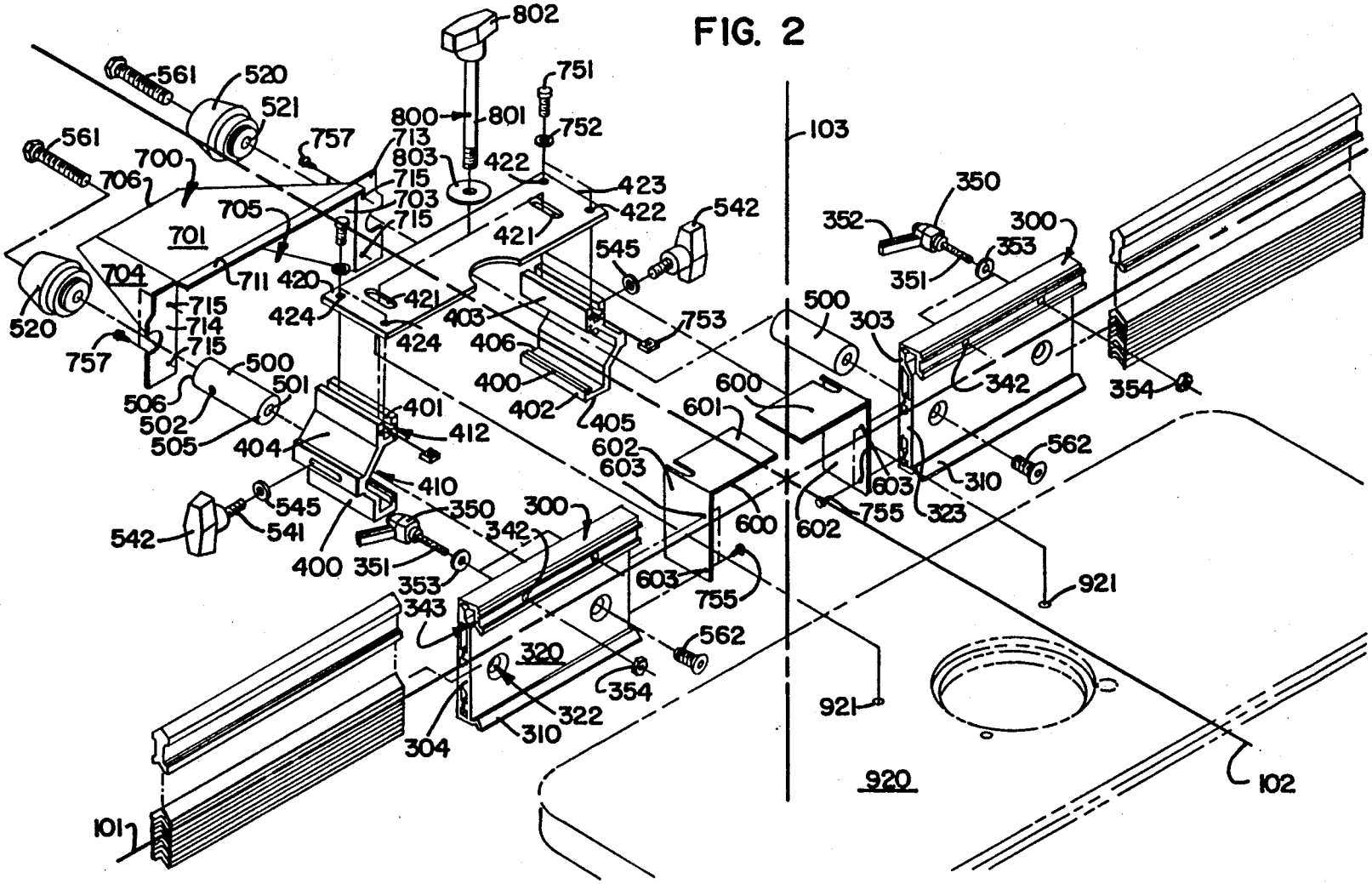
FIG. 2 is an exploded perspective view of the invention depicted in FIG. 1.
Figure 3:
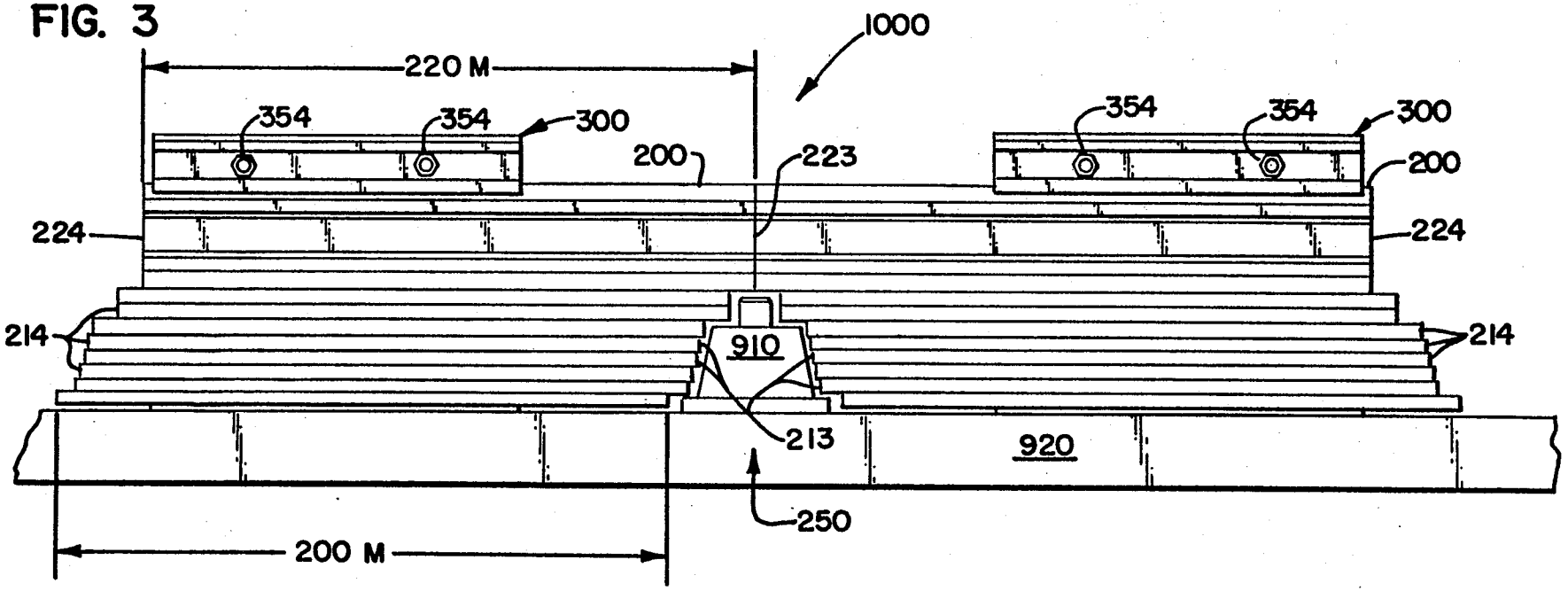
FIG. 3 is a front elevational view of the invention depicted in FIG. 1.

Referring to FIGS. 2 and 3, the guide fence 100 includes a pair of identical guide fence assemblies 200 which are placed to the right and left of the cutting tool 910 to create a guiding surface 230 with the cutting tool 910 accommodated within a gap 250 between the fence assemblies 200. Each fence assembly 200 is independently adjustable in both the longitudinal 101 and lateral 102 directions. Lateral adjustment of the fence assemblies 200 permits lateral alignment of the guide fence assemblies 200 with respect to the cutting tool 910 and with respect to one another. Longitudinal adjustment permits configuration of the gap 250 between the fence assemblies 250 about the cutting tool 910.

Figure 7:
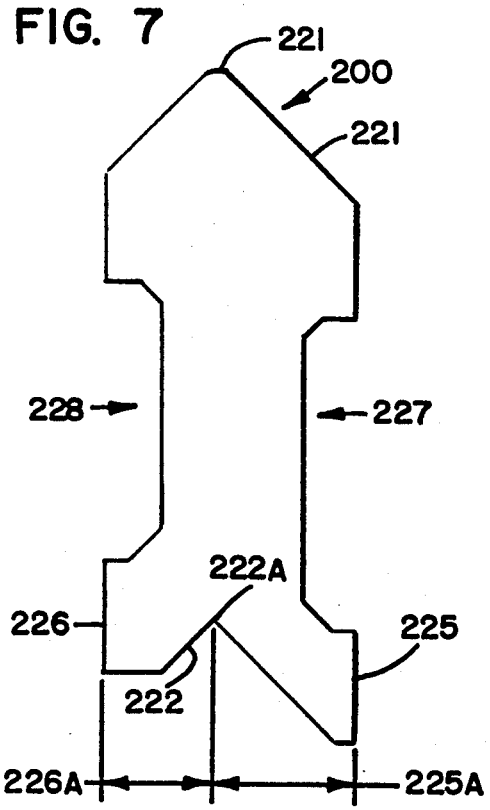
FIG. 7 is a side view of one of the large fence segments.
Figure 6:
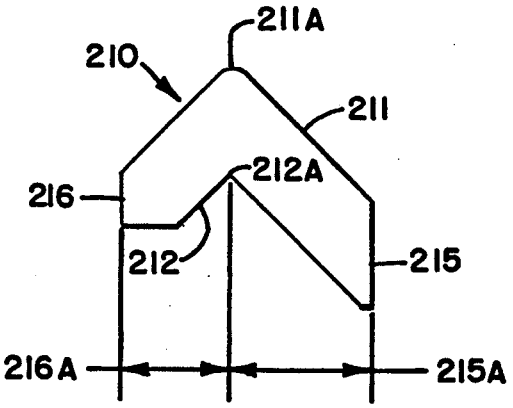
FIG. 6 is a side view of one of the small fence segments.

Referring to FIGS. 6 and 7, the guiding surface 230 of each fence assembly 200 is created by a plurality of transversely stacked small fence segments 210 capped with a large fence segment 220. The small fence segments 210 are longitudinally elongated members with a generally V-shaped cross-section. The top surface 211 of the small fence segments 210 are convex with a definitive apex 211*a*. The bottom surface 212 of the small fence segments 210 are concave with a definitive nadir 212*a*. The front 215 and rear 216 surfaces of the small fence segments 210 are parallel. The top 211 and bottom 212 of the small fence segments 210 provide complemental surfaces which accommodate transverse stacking of the small fence segments 210 with the top convex surface 211 of one segment 210 nested within the concave bottom surface 212 of an adjacent segment 210.

Figure 4:
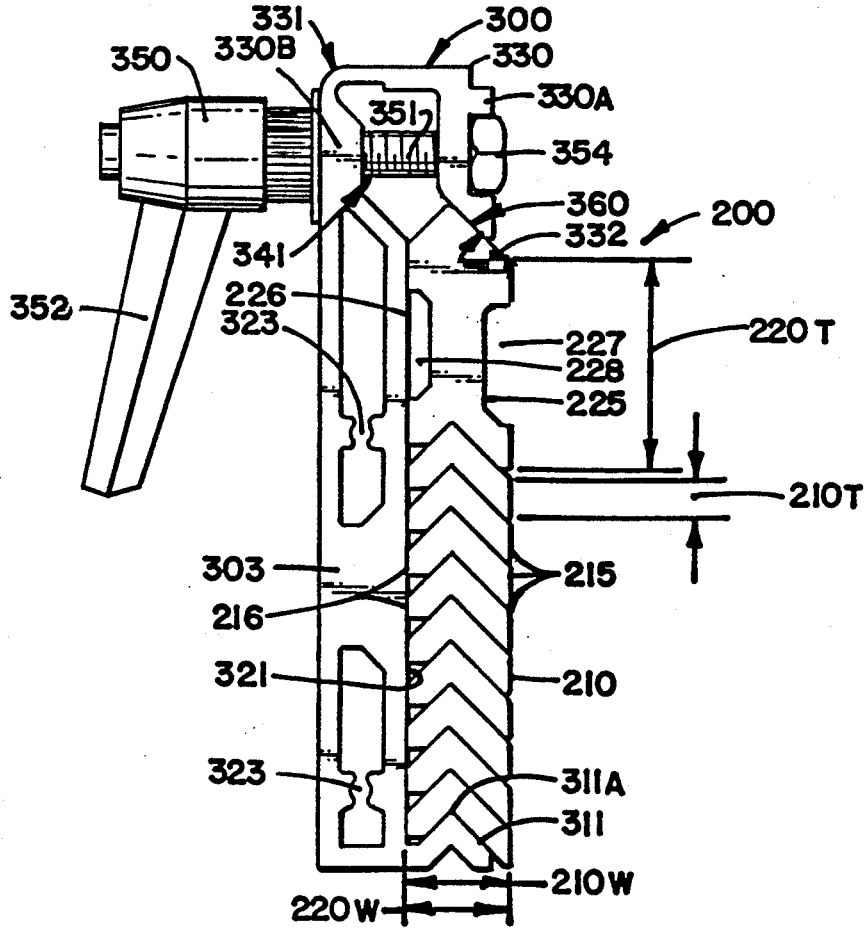
FIG. 4 is a side view of the fence assembly and segment clamp assembly of the invention depicted in FIG. 1.

Referring to FIG. 4, transverse stacking of the small fence segments 210 produces a flat guiding surface 230 from the front surfaces 215 of the small fence segments 210. Planar alignment of the front surfaces 215 of the stacked small fence segments 210 is achieved by transversely aligning the apex 211*a* at the top 211 of a small fence segment 210 with the nadir 212*a* at the bottom 212 of the small fence segment 210 such that a plane encompassing the apex 211*a* and the nadir 212*a* is parallel to the front surface 215 of the small fence segment 210.

The top 211 and bottom 212 surfaces of the small fence segments 210 are smooth so as to permit transversely stacked segments 210 to be independently slipped past one another in the longitudinal direction 101. The ability to independently move the small fence segments 210 in the longitudinal direction 101 permits the inner ends 213 of the small fence segments 210 to define substantially any desired gap 250 configuration within limits established by the thickness 210*t* of the small fence segments 210.

A sufficient number of small fence segments 210 should be provided in each fence assembly 200 to permit shaping of the fence assembly 200 from the working surface 920 to the top of the cutting tool 910. Hence, the number of small fence segments 210 which should be employed in each fence assembly 200 depends upon a combination of the height of the cutting tool 910 above the working surface 920 and the thickness 210*t* of the small fence segments 210. Typical power tools which require a guiding surface 230 aligned with the cutting tool 910 have a cutting tool 910 which extends about 0.5 cm to about 10 cm above the working surface 920. The small fence segments 210 preferably have a thickness of about 0.2 to about 1 cm as small fence segments 210 of less than about 0.2 cm are difficult to manufacture, easily damaged, and increase the difficulty of assembling and adjusting the fence assembly 200 while small fence segments 210 having a thickness 210*t* of greater than about 1 cm do not provide sufficient conformability about the cutting tool 910 and can result in substantial spaces between the inner ends 213 of the small fence segments 210 and the cutting tool 910 despite longitudinal adjustability of the fence segments 210.

Accordingly, about three to about twenty small fence segments 210 having a thickness of about 0.2 to about 1 cm is generally effective for achieving the desired degree of adjustability.

Referring to FIG. 7, a large fence assembly segment 220 is provided with each fence assembly 200 for placement at the top of a stack of small fence segments 210 for increasing the height of the guiding surface 230 after the guiding surface 230 is above the cutting tool 910. As with the small fence segments 210, the large fence segments 220 are longitudinally elongated members with a generally V-shaped cross-section and define (i) a convex top surface 211 with a definitive apex 211*a*, (ii) a concave bottom surface 212 with a definitive nadir 212*a*, and (iii) parallel front 215 and rear 216 surfaces.

Longitudinally extending central channels 227,228 are respectively provided in the front 225 and rear 226 of the large fence segments 220 for controlling the size and weight of the large fence segments 220 while still providing a planar guiding surface 225 proximate the top 221 and bottom 222 of the large fence segments 220.

The thickness 220*t* of the large fence segments 220 is preferably about 2 to 5 cm.

Selection of the width 210*w*,220*w* of the small 210 and large 220 fence segments requires a balancing of the competing interest of cost (increased width=increased cost), structural integrity (increased width=increased structural integrity), and stacked stability (increased width=increased stacked stability). Generally, a width of about 1 to about 3 cm provides an appropriate balancing of these competing interests.

Likewise, selection of the length 210*m*,220*m* of the small 210 and large 220 fence segments requires a balance of the competing interests of cost (increased length=increased cost), functionality (increased length=increased functionality as a guiding surface), and risk of deviations (increased length=increased risks of deviations and imperfections in the guiding surface). Generally, a length 210*m*,220*m* of about 20 to about 50 cm provides an effective balance between these competing interests.

Referring to FIGS. 1,2 and 4, each fence assembly 200 is clamped into position by a segment clamp 300. The base 310 of the segment clamp 300 has a V-shaped top surface 311 with a definitive apex 311*a* for nesting within the concave bottom surface 212 of a small fence segment 210. A vertical side wall 320 extends upwardly from the base 310 of the segment clamp 300 to provide a planar front surface 321 against which the rear surfaces 216,226 of the fence segments 210,220 may be constrained. Because the front 215,225 and rear 216,226 surfaces of the fence segments 210,220 are parallel, such planar constrainment of the rear surfaces 216,226 of the fence segments 210,220 causes the front surfaces 215,225 of the fence segments 210,220 to produce a planar guiding surface 230.

The fence segments 210,220 are configured with a rear leg 216*a*,226*a* which is slightly shorter than the front leg 215*a*,225*a* as the rear leg 216i a of the lowermost small fence segment 210 must accommodate connection of the base 310 to the sidewall 320 while the front leg 215*a* preferably extends into contact with the working surface 920.

The top 330 of the segment clamp 300 includes a front portion 330*a* and a rear portion 330*b* separated by a diagonal channel 341. The diagonal channel 341 creates a longitudinal flex line 331 across the top 330 of the segment clamp 300 about which the front portion 330*a* may be laterally pivoted with respect to the rear portion 330*b*.

Pivoting of the top front portion 330*a* of the segment clamp 300 with respect to the top rear portion 330*b* is effected by a pair of longitudinally spaced clamping knobs 350. The shaft 351 of each clamping knob 350 extends laterally through an orifice 342 which passes through both the top front 330*a* and top rear 330*b* portions of the segment clamp 300 and threadably engages a nut 354 retained within a channel 343 in the top front portion 330*a* of the segment clamp 300. The nut 354 is retained within the channel 343 such that the nut 354 is not rotated by rotation of the shaft 351.

Figure 5:
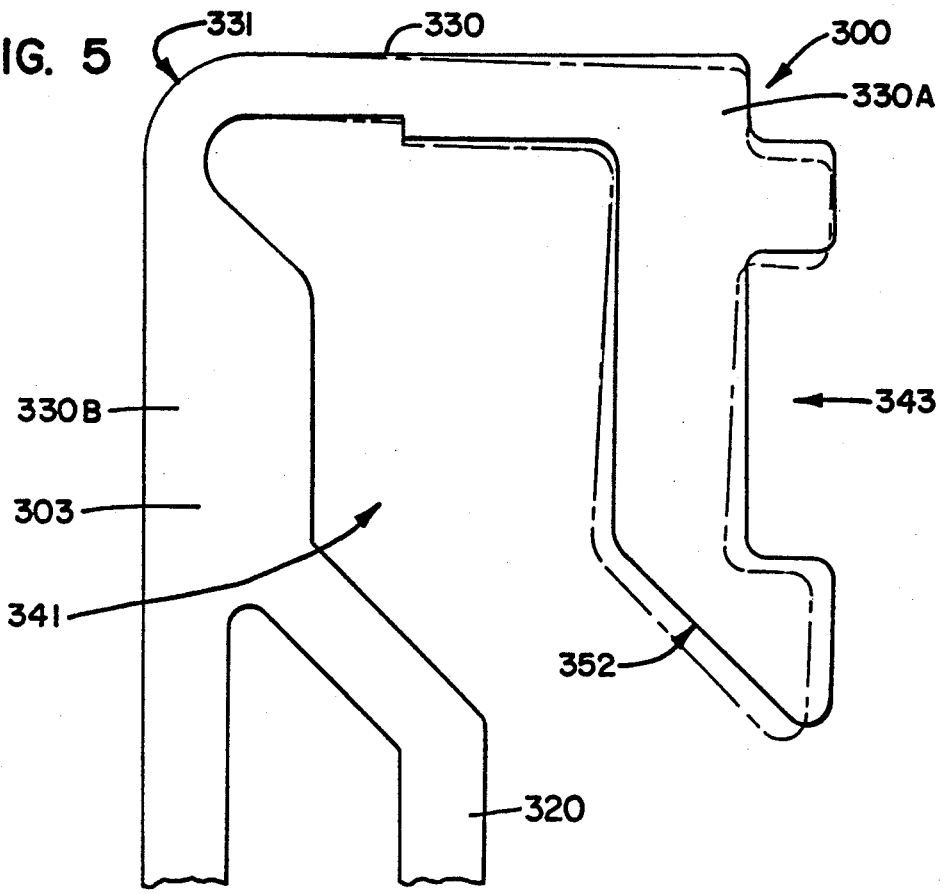
FIG. 5 is an enlarged view of a portion of the segment clamp depicted in FIG. 4 demonstrating the segment clamp in the open and closed positions.

Referring to FIG. 5, the contacting surface 332 of the top front portion 330*a* exerts a clamping force upon the stacked fence assembly 200 at approximately a 45° angle towards the base 310 and sidewall 320 of the segment clamp 300 so as to simultaneously coerce the fence segments 210,220 against the base 310 and sidewall 320 of the segment clamp 300.

The clamping knobs 350 are include wratchet style handles 352 which permit the handle 352 to be placed in either a first operable mode for rotatably driving the shaft 351 or a second operable mode for rotatably repositioning the handle 352 about the shaft 351. Such wratchet-style levers are readily available from a number of suppliers including Jergens Distrubutors of Cleveland, Ohio.

Referring to FIG. 2, each segment clamp 300 is laterally coupled to the front end 705 of a tube 500 by the means of a threaded bolt 562 which extends through one of two longitudinally spaced apertures 322 in the side wall 320 of the segment clamp 300 and into a threaded central bore 501 in the tube 500. The apertures 322 through the side wall 320 of the segment clamp 300 are recessed to insure that the bolt 562 does not interrupt the planar front surface 321 of the side wall 320. The pair of apertures 321 permits longitudinal positioning of the segment clamp 300 and fence assembly 200.

Each tube is slidably retained within the central passageway 410 of a support half 400.

The threaded shaft 541 of a tube locking knob 540 extends through a slit 411 in the outer surface 404 of the support half 400 and into a threaded orifice 502 in the side of the tube 500. When tightened, the tube locking knob 540 retains the tube 500 in position with respect to the support half 400. When loosened, the tube locking knob 540 permits limited lateral repositioning of the tube 500 within the central passageway 410 based upon the lateral length of the slit 411 in the outer surface 404 of the support half 400.

The support halves 400 are coupled together by a cover plate 420. The cover plate 420 is attached to each support half 400 by a pair of machine screws 751 which extend through a pair of laterally spaced orifices 422 proximate each side 423,424 of the cover plate 420 and threadably engage a nut 753 retained within a T-shaped channel 412 in the top 401 of the support halves 400. The T-shaped channel 412 retains the nut 753 such that the nut 753 is not rotated by rotation of the machine screw 751 and is transversely restrained from moving towards the cover plate 420.

An L-shaped dust deflector plate 600 is coupled to the inner end 303 of each segment clamp 300 by a pair of machine screws 755 which extend through a pair of transversely spaced orifices 603 in the side 602 of the dust deflector plate 600 and into threaded holes 323 in the inner end 303 of the segment clamp 300.

The dust deflector plates 600 define the top 601 and sides 602 of a laterally extending passageway (unnumbered) extending from the segment clamps 300 to a dust chute 700.

The dust chute 700 is open at the front 705 and bottom (unnumbered) and tapers from front 705 to back 706. The dust chute 700 sets upon the working surface 920 with the back 706 of the dust chute 700 extending slightly beyond the edge of the table 920 so as to create a passageway (unnumbered) extending through the duct chute 700 from front 705 to back 706 with intake through the open front 705 and venting through the open bottom between the back 706 of the dust chute 700 and the edge of the working surface 920.

Flanges 713,714 extend from the sides 703,704 of the dust chute 700 for connecting the dust chute 700 to the support halves 400 with machine screws 757. The machine screws 757 extend through a pair of transversely space orifices 715 in each side flange 713,714 and into threaded holes (not shown) in the rear 406 of the support halves 400.

A fine tuning knob 520 is rotatably secured to each side flange 713,714 of the dust chute 700 within a circular indentation 716 in the side flanges 713,714 so as to prevent lateral movement of the fine tuning knob 520 relative to the dust chute 700. Each fine tuning knob 520 is also connected to the rear end 506 of one of the tubes 500 by a bolt 561 which extends through a central bore 521 in the fine tuning knob 520 and into a threaded portion of the central bore 501 in each tube 500. The bolts 561 connect the fine tuning knobs 520 and tubes 500 such that rotation of a fine tuning knob 520 causes the associated bolt 561 to rotate within the central bore 501 of the associated tube 500 and thereby cause the tube 500 to be laterally repositioned within the central passageway 410 in the support half 400.

A top front flange 711 extends upwardly from the top 701 of the dust chute 700 for providing continuity betwee the dust deflector plates 600 and the dust chute 700.

The guide fence 100 is secured to the working surface 920 by means of a pair of support half locking knobs 800. The shaft 801 of each support half locking knob 800 is coupled to a handle 802 at one end and threaded at the other end. The threaded end of the shaft 801 transversely extends through a laterally elongated slit 421 in the cover plate 420 and is threadably inserted into a threaded hole 921 in the working surface 920. The lateral size of the slits 421 dictate the extent to which the cover plate 420 may be laterally repositioned with respect to the working surface 920.

In use, the support halves 400, cover plate 420, fine tuning knobs 520, and dust chute 700 are permitted/prevented from moving laterally with respect to the working surface 920 by support half locking knobs 800 while the fence assemblies 200, segment clamps 300, tubes 500 and dust deflectors plates 600 are permitted/prevented from moving laterally with respect to the support halves 400 by tube locking knobs 540.

The components of the fence assembly 200 may be constructed from any material possessing sufficient structural integrity including metals such as steel and aluminum and plastics such as polyester and polyvinyl chloride.

OPERATION

Initial positioning of the guiding surfaces 230 on the guide fence 100 includes the steps of (i) securing the segment clamps 300 to the tubes 500 with a bolt 562 by passing the bolt 562 through whichever of the orifices 322 in the sidewall 320 of the segment clamps 300 causes the segment clamp 300 to clamp closest to the longitudinal center of the large fence segment 220 retained within the segment clamp 300 when the large fence segment 220 is operably positioned, (ii) stacking the small 210 and large 220 fence segments upon the bases 310 of the segment clamps 300, (iii) tightening the clamping knobs 350 until the contacting surfaces 332 of the segment clamps 300 securely contact the front top portions **221*b* of the large fence segments 220 and force the rear surfaces 216,226 of the stacked fence segments 210,220 within the segment clamp 300 against the front surface 321 of the segment clamp sidewall 320, (iv) placing a straight edge (not shown) against the guiding surfaces 230 of both fence assemblies 200, (v) independently adjusting the lateral position of each fence assembly 200 by rotating the associated fine tuning knob 520 until the guiding surface 230 of the fence assemblies 200 are longitudinally aligned with the straight edge, (vi) tightening the tube locking knobs 540 to secure the tubes 500 to the support halves 400, (vii) laterally positioning the support halves 400 with respect to the cutting tool 910 by moving the entire guide assembly 100, and (viii) tightening the support half locking knobs 800 to secure the support halves 400 against the working surface 920**.

The specification is provided to aid in a complete nonlimiting understanding of the invention. Since many variations and embodiments of the invention may be made without departing from the spirit and scope of the invention, the invention resides in the claims hereinafter appended.

I claim:

1. A guide fence comprising a longitudinally extending planar guiding surface having a first half and a second half having a gap therebetween for accommodating a cutting mechanicm, each half comprising a plurality of vertically stacked members, wherein the members are independently movable so as to be operable to adjust the size and shape of the gap to accommodate variously sized cutting mechanisms.

2. A guide fence comprising:

(a) a plurality of longitudinally elongated members having (i) first and second longitudinal ends, (ii) first and second lateral sides, and (iii) first and second transverse surfaces wherein the first surface is laterally convex and the second surface is laterally concave, and (b) a means for releasability coupling at least two nested elongated members so as to create a flat surface from the first lateral sides of the coupled members.

3. The guide fence of claim 2 wherein the longitudinally elongated members are about 10 to about 100 cm long in the longitudinal direction, about 0.5 to about 5 cm wide in the lateral direction, and about 0.2 to about 3 cm thick in the transverse direction.

4. The guide fence of claim 3 wherein the longitudinally elongated members are about 20 to about 50 cm long in the longitudinal direction, about 1 to about 1 cm wide in the lateral direction, and about 0.5 to about 1 cm thick in the transverse direction.

5. The guide fence of claim 4 wherein the laterally convex surface of each longitudinally elongated member defines a right angle having a definitive apex and the laterally concave surface of each longitudinally elongated member defines a right angle having a definitive nadir.

6. The guide fence of claim 4 wherein the plane defined by the first lateral side of each longitudinally elongated member is parallel to a central plane extending through the apex of the convex surface and the nadir of the concave surface on the longitudinally elongated member.

7. The guide fence of claim 6 wherein the planes defined by the first and second lateral sides of each longitudinally elongated member are parallel.

8. The guide fence of claim 4 wherein the plurality of longitudinally elongated members comprise at least three longitudinally elongated members which are substantially dimensionally identical.

9. The guide fence of claim 3 wherein the plurality of longitudinally elongated members comprise at least five longitudinally elongated members which are substantially dimensionally identical.

10. The guide face of claim 4 wherein the coupling means is a clamp comprising (i) a longitudinally extending base having an upper surface operable for nesting against one of the transverse surfaces of a longitudinally elongated member, (ii) a sidewall extending substantially transversely from the base which presents a longitudinally elongated, flat bearing surface, and (iii) a means for applying clamping pressure upon a plurality of transversely nested longitudinally elongated members stacked upon the base of the clamp with the second lateral surface of the members facing the sidewall of the clamp so as to retainably force the members against the base and the sidewall of the clamp and thereby define a flat guiding surface from the first lateral sides of the stacked members.

11. The guide fence of claim 7 wherein the coupling means is a clamp comprising (i) a longitudinally extending base having an upper surface operable for nesting against one of the transverse surfaces of a longitudinally elongated member, (ii) a sidewall extending substantially transversely from the base which presents a longitudinally elongated, flat bearing surface, and (iii) a means for applying clamping pressure, at an angle of about 45° with respect to the bearing surface, upon a plurality of transversely nested longitudinally elongated members stacked upon the base of the clamp with the second lateral surface of the members facing the sidewall of the clamp so as to retainably force the members against the base and the sidewall of the clamp and thereby define a flat guiding surface from the first lateral sides of the stacked members.

12. The guide fence of claim 4 comprising two coupling means operable for separately coupling at least two nested elongated members so as to create a first flat surface from the first lateral sides of the coupling members within a first of the coupling means and a second flat surface from the first lateral sides of the coupling members within a second of the coupling means.

13. The guide fence of claim 12 further comprising a means for longitudinally aligning the first and second flat surface.

14. The guide fence of claim 13 wherein the longitudinal alignment means laterally positions at least one of the coupling means.

* * * * *

UNITED STATES PATENT AND TRADEMARK OFFICE

CERTIFICATE OF CORRECTION

PATENT NO. : 5,016,693

DATED : May 21, 1991

INVENTOR(S) : Jeff L. Haffely et al.

It is certified that error appears in the above-identified patent and that said Letters Patent is hereby corrected as shown below:

In Column 2, line 54, please insert --fence segments-- after the word "large"

In Column 2, line 55, please delete "221ib:" and substitute therefore --221b:--

In Column 3, line 53, please delete "602:" and substitute therefore --601:--

In Column 6, line 7, please delete "216i a" and substitute therefore --216a--

In column 6, line 38, please delete "are" after 350

In column 6, line 38, please delete "wratchet style" and substitute therefore --wratchet-style--

In column 6, line 44, please delete "Distrubutors" and substitute therefore --Distributors--

In column 7, lines 56 and 57, please delete "bet-wee" and substitute therefore --between--

UNITED STATES PATENT AND TRADEMARK OFFICE

CERTIFICATE OF CORRECTION

PATENT NO. : 5,016,693

DATED : May 21, 1991

INVENTOR(S) : Jeff L. Haffely et al.

It is certified that error appears in the above-identified patent and that said Letters Patent is hereby corrected as shown below:

In Column 8, line 6, please delete "deflectors" and substitute therefore --deflector--

In Column 8, line 57, Claim 1, please delete "mechanicm" and substitute therefore --mechanism--

In Column 10, line 31, Claim 12, please delete "coupling" and substitute therefore --coupled--

In Column 10, line 33, Claim 12, please delete "coupling" and substitute therefore --coupled--

Signed and Sealed this

Seventeenth Day of November, 1992

*Attest:*

DOUGLAS B. COMER

*Attesting Officer*

*Acting Commissioner of Patents and Trademarks*